United States Patent [19]

Tsunemura et al.

[11] Patent Number: 4,460,030

[45] Date of Patent: Jul. 17, 1984

[54] COLLAPSIBLE GARAGE DOOR

[75] Inventors: Kazuo Tsunemura, Chicago; Kiyoshi Iha, Elk Grove Village; Anthony T. Janiszewski, Elmwood Park, all of Ill.

[73] Assignee: Chamberlain Manufacturing Corporation, Elmhurst, Ill.

[21] Appl. No.: 428,328

[22] Filed: Sep. 29, 1982

[51] Int. Cl.[3] ..... E06B 9/32

[52] U.S. Cl. ..... 160/35

[58] Field of Search ..... 160/35, 32, 201, 202, 160/206, 209, 33, 36

[56] References Cited

U.S. PATENT DOCUMENTS

| | | | |
|---|---|---|---|
| 1,762,480 | 6/1930 | Marenti | 160/319 |
| 2,090,099 | 8/1937 | Bittorf et al. | 160/209 X |
| 2,175,323 | 10/1939 | Shephard | 160/206 |
| 2,493,815 | 1/1950 | Guilbert, Jr. | 160/206 |
| 2,586,561 | 2/1952 | Poggi | 160/206 |
| 2,729,287 | 1/1956 | Goldner | 160/235 X |
| 3,280,888 | 10/1966 | Davis . | |
| 3,941,180 | 3/1976 | Thill | 160/201 |
| 4,274,227 | 6/1981 | Toenjes . | |
| 4,379,478 | 4/1983 | Lichy | 160/35 |

FOREIGN PATENT DOCUMENTS

| | | | |
|---|---|---|---|
| 610054 | 3/1979 | Switzerland | 160/35 |

*Primary Examiner*—Peter M. Caun
*Assistant Examiner*—Cherney S. Lieberman
*Attorney, Agent, or Firm*—Hill, Van Santen, Steadman & Simpson

[57] ABSTRACT

An improved sectional overhead garage door with an integral automatic opener and closer which comprises a plurality of horizontal sections which are hinged together on opposite sides in alternate fashion and wherein the panels are made strong and light by providing parallel sheets of plastic aluminum or steel which are held along the edges with aluminum extrusions and where the hollow insides of the panels are filled with foam to provide rigidity and strength. The door as it is opened folds up like an accordian with adjacent sections folding back upon themselves so that a very compact unit is provided.

6 Claims, 8 Drawing Figures

COLLAPSIBLE GARAGE DOOR

BACKGROUND OF THE INVENTION

1. Field of the Invention

This invention relates in general to an integral overhead door and opener and in particular to a novel folding door which utilizes much less space and is much lighter than doors of the prior art.

2. Description of the Prior Art

Prior art garage doors for homes are built with several sections so they can be rolled up and stored overhead and move on a pair of rails so that the door moves from a vertical position to a horizontal position. Since the door when in the horizontal position has the same size as when it is in the vertical position it covers a large area of the ceiling and requires a large framework of tracks and straps. Compact garage doors are known which comprise thin metal which can be rolled up into a cylinder but which offers little insulation properties and has very little esthetics.

SUMMARY OF THE INVENTION

The present invention relates to a sectional overhead garage door and an integral automatic opener and closer and has an object to provide an improved and superior overhead garage door.

Although the invention is described partly in connection with residential garages and it is particularly advantageous in such usage, it should be understood that this is merely by way of example and that the invention has equal application for any type of overhead doors such as commercial doors.

It is an object of the present invention to provide a unit which can be quickly installed and in a simple manner and which includes an automatic door opener which is integrally provided and installed at the same time the door is installed.

In a particular embodiment, ten horizontal door panels were constructed from two separate sheets of plastic aluminum or steel which were held along both long edges with an aluminum extrusion and in a particular example the door was approximately 7 feet high, 1 inches thick and had lengths which vary from 8 to 18 feet.

The inside of the hollow shape of the door panels is filled with foam to provide rigidity and strength, as for example, styrofoam or other types of foam. The opposite ends are closed with an aluminum assembly to which a roller or pick-up bar is attached and the rollers run along guide tubes mounted on opposite sides of the door so as to maintain the proper direction for the door and movement during door travel. Each panel is connected to an adjacent panel by hinges which are alternately placed in the front and rear of the panels so that the panels can be alternately folded in one direction and then in the other direction flat against each other to assure that minimum space will be utilized with the folded door. By folding the panels in this manner, the thickness of the panels will not effect its operation. This also permits the panels to be made of any suitable material. By selectively using materials having desired properties, the insulation factor "R" can be greatly improved over doors of the prior art. Also, the appearance of the doors is very attractive. The weight of the door is substantially decreased over doors of the prior art making the entire structure easier to install. Painting of the door will be unnecessary reducing the maintenance and only oiling or greasing of the door need be done. The hinges will be attached to extrusions. As each panel reaches the storage area at the top. two curved steel rails will contact the pin inserted at the top of every other panel to guide the panel around the bend and keep each piece standing upright on its rollers side by side. Such storage method will utilize the minimum amount of space above the door and this will also prevent the panels from sagging and developing a permanent bend in the event the panel remains at the top for long periods of time. To prevent the top panel from following the other panels too closely during the closing cycle which could cause a blockage, the roller guide is made slightly longer to maintain a slight gap of air between the door and jam and weather stripping is used to close any air gaps. Weather stripping may also be used between each panel. An automatic door opener is designed to operate with this door to improve its efficiency and to maintain the entire unit compact and utilizes no more space than the door by itself. The opener is located on one side of the door and is coupled to a drive shaft which also transmits power to the other side of the door. Two take-up cable reels with left and right hand grooves are mounted on the drive shaft with one on each side of the door. One end of a length of steel cable is attached to the side of the door threaded around an idler pulley mounted at the bottom of the door jam and return to the top and attach to the take-up reel. The operation is such that as the drive shaft is rotated by the door opener. the cable will unwind from one take-up reel as it is wound on the other. A counter spring for counter balancing the weight of the door is mounted on each side of the door so that each spring counter balances half of the weight of the door.

The result is a door which comprises substantial improvements over those of the prior art.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
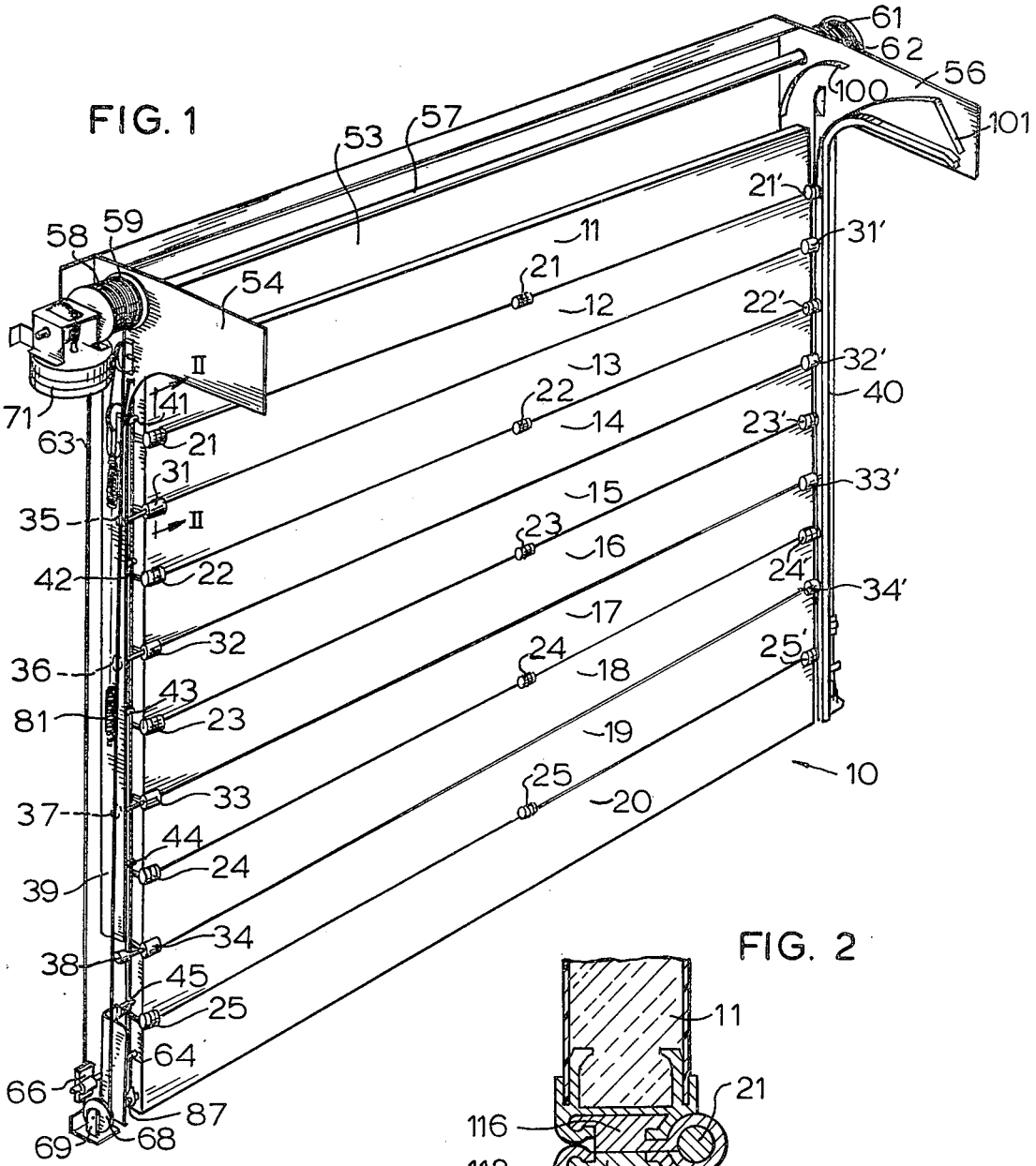
FIG. 1 is a perspective view of the invention.

The garage door 10 is formed of a plurality of panels 11 through 20 which are hinged together with alternate hinges being on the inner side of the door and designated as hinges 21 between panels 11 and 12, hinges 22 between panels 13 and 14, hinges 23 between panels 15 and 16, hinges 24 between panels 17 and 18, and hinges 25 between panels 19 and 20. Hinges on the front edges of the door are provided between the panels and alternate between the hinges 21 through 25. Thus, panels 12 and 13 are connected by hinges 26, panels 14 and 15 are connected by hinges 27. Panels 16 and 17 are connected by hinges 28 and panels 18 and 19 are connected by hinges 29.

Rollers are supported between panels 12 and 13, panels 14 and 15, panels 15 and 16 and panels 18 and 19. These rollers are supported on roller shafts 31, 32, 33 and 34 which respectively carry rollers 35, 36, 37 and 38. Roller shafts 31', 32', 33' and 34' are supported on the opposite ends of panels 12 and 13, panels 14 and 15, panels 16 and 17, and panels 18 and 19. Hinges 21' through 25' are carried on the opposite ends of the panels with hinge 21' being between panels 11 and 12, hinge 22' being between panels 13 and 14, hinge 23' being between panels 15 and 16, hinge 24' being between panels 17 and 18, and hinge 25' being between panels 19 and 20. These rollers extend from both ends of the door and are guided in guide rails 39 and 40. The panel 11 has guide pins 41 which engage the forward edge of the rails 39 and 40 but do not ride in the rail groove. The panel 13 is provided with guide pins 42, the panel 15 is provided with guide pins 43, and the panel 17 is provided with guide pin 44 and panel 19 is provided with guide pins 45 which extend from opposite ends thereof.

A frame member 53 has sides 54 and 56 and a drive shaft 57 extends between side members 54 and 56 and on one side of the door supports a pull-up reel 58 and a pull-down reel 59; on the other side of the door supports a pull-down reel 61 and a pull-up reel 62. A cable 63 extends from the pull-up reel 58 to an arm 64 which is attached to the lower panel 20 of the door by a clamp 66. A cable 67 is attached to the arm 64 by clamp 66 and passes around an idler pulley 68 which is supported by a suitable bracket 69 and extends to the pull-down reel 59.

A motor 71 has an output worm 72 which drives a gear 73 mounted on shaft 57 to drive the pull-up and pull-down reels to open and close the door.

A spring 81 has one end connected to the rail 39 with a pin 82. The upper end of spring 81 is rotatably connected to a pulley 83 over which a cable 84 extends. The cable 84 passes over a pulley 86 supported by the frame member 53 and extends down and connects to the door panel 20 with a pin 87. The other end of the cable 84 is connected to the frame member 53 by a pin 88. It is to be realized, of course, that there is a counter spring 81 with the associated pulleys and cable on the other side of the door but only one side of the door is illustrated with the counter spring, and they are mirror images of each other.

Figure 3:
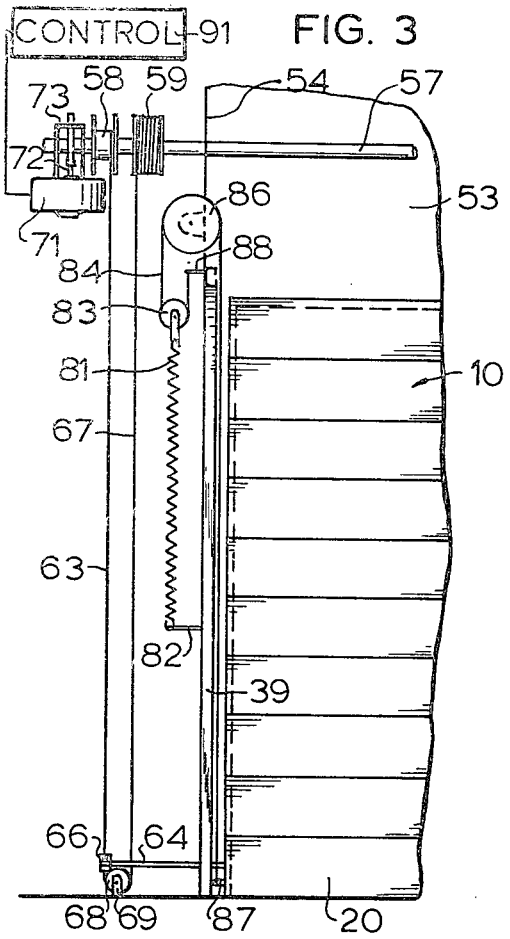
FIG. 3 is a partially broken away view illustrating the door in the closed position.

A control 91 for actuating the door may be a manual switch or a radio receiver such as manufactured by the Chamberlain Manufacturing Company and such circuits are well known to those skilled in the art. When the motor 71 is energized when the door is in the down position as illustrated in FIGS. 1 and 3, the pull-up reels 58 and 62 are turned by the shaft 57 such that the cable 63 winds around the reel 58 to pull the door upward with the pick-up bar 64. Simultaneously, the reel 59 is rotated by the shaft 57 to pay out cable 67 so that as the door is opened the reel 58 will be taking up cable and the reel 59 will be paying out cable.

Figure 5:
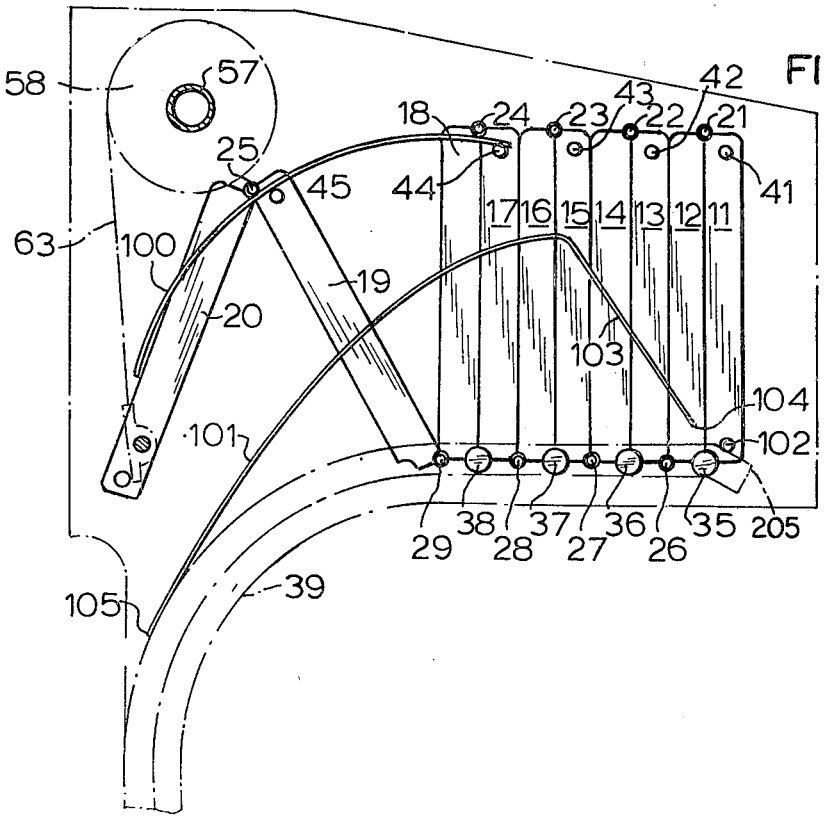
FIG. 5 is a detailed view illustrating the door in the open position with the panels folded.
Figure 8:
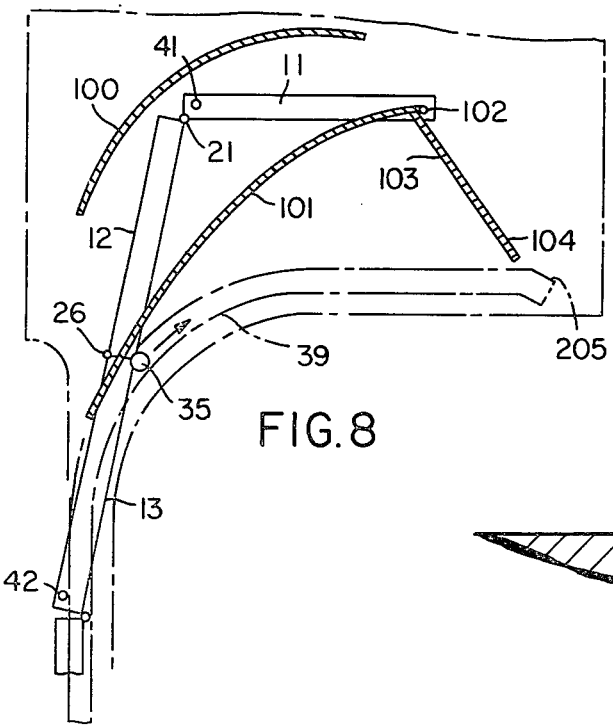
FIG. 8 illustrates one of the panels in a horizontal position.

As best seen in FIG. 5, a pair of curved rails 100 and 101 are mounted from the inner surfaces of the side members 54 and 56 and as the upper panel 11 is moved upwardly its upper end has pins 102 which engage the rail 100 so as to pivot the panel 11 toward the horizontal position. As the door is moved upwardly, the panel 11 will pass from the horizontal position to the vertical position as shown in FIG. 5 and will pass down the rear portion 103 of rail 101 and passes beyond the end 104 of rear portion 103. Pin 102 then rests on the end portion 205 of rail 39. FIG. 8 illustrates the panel 11 in the horizontal position and pin 102 has caused the panel 11 to move to the horizontal position due to its engagement with rail 100. As the panel 11 continues to move to the right relative to FIG. 8, its weight will cause the panel 11 to move so that pin 102 engages the downwardly extending portion 103 of rail 101 and, thus, the panel 11 will have changed direction approximately 180° from when in the door closed position illustrated in FIG. 1, for example. The roller 35 which is connected to panel 12 will move along the rail 40 to the position shown in FIG. 5. As is shown in FIG. 5, since the hinges are alternately placed on the front and back of adjacent panels, the door can fold in an accordian fashion as illustrated in FIG. 5 which will require the minimum space for the door storage. It is to be noted that the first panel 11 makes a 180° turn in that it goes up and then folds down to the position shown in FIG. 5 due to the position of the guide rails 100, 101. When the door is opened, the motor 71 is turned off and the conventional control circuit includes limit switches for limiting the upper and lower positions of the door. Also, the control system may include obstruction sensing circuitry so as to stop the closing of the door if an obstruction is encountered by the door. Such circuits are conventional and the detail description is not included herewith.

Figure 4:
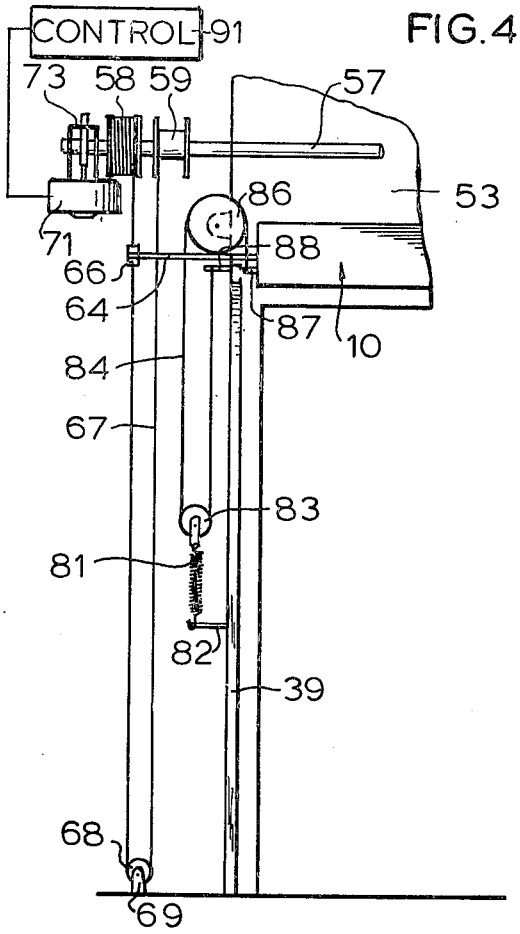
FIG. 4 is a partially cut-away view illustrating the door in the open position.

When the door is to be closed, the control circuit 91 is energized and the motor 71 rotates in the opposite direction to drive the reels 58, 59, 61 and 62 in the direction opposite to that which they rotated when the door was opened. The cable 67 will pull the door down after passing over drive idler pulley 68 and each successive panel will move down the rails 39 and 40 to the closed position. The top panel 11 has a pin 102 at its unpivoted end which will pass under the lower end 105 on the upper surface of the rail 40 to the closed position illustrated in FIGS. 1 and 3. The operation of the counter weight spring 81 and cable 84 is as illustrated in FIGS. 3 and 4. When the door is closed, the spring 81 is extended since the lower end of the cable 84 is near the floor and the pulleys 83 and 86 stretch the spring 81. As the door is opened, the pulley 83 will travel one-half the distance of the door and when the door is opened, the spring 81 will be in the position illustrated in FIG. 4.

Figure 2:
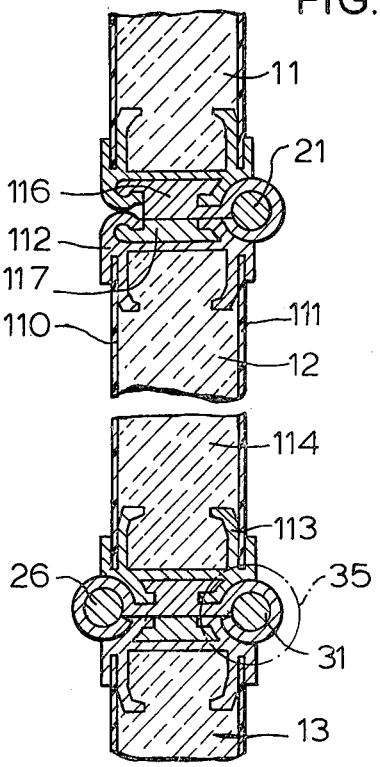
FIG. 2 is a sectional view through a pair of the panels of the invention.
Figure 6:
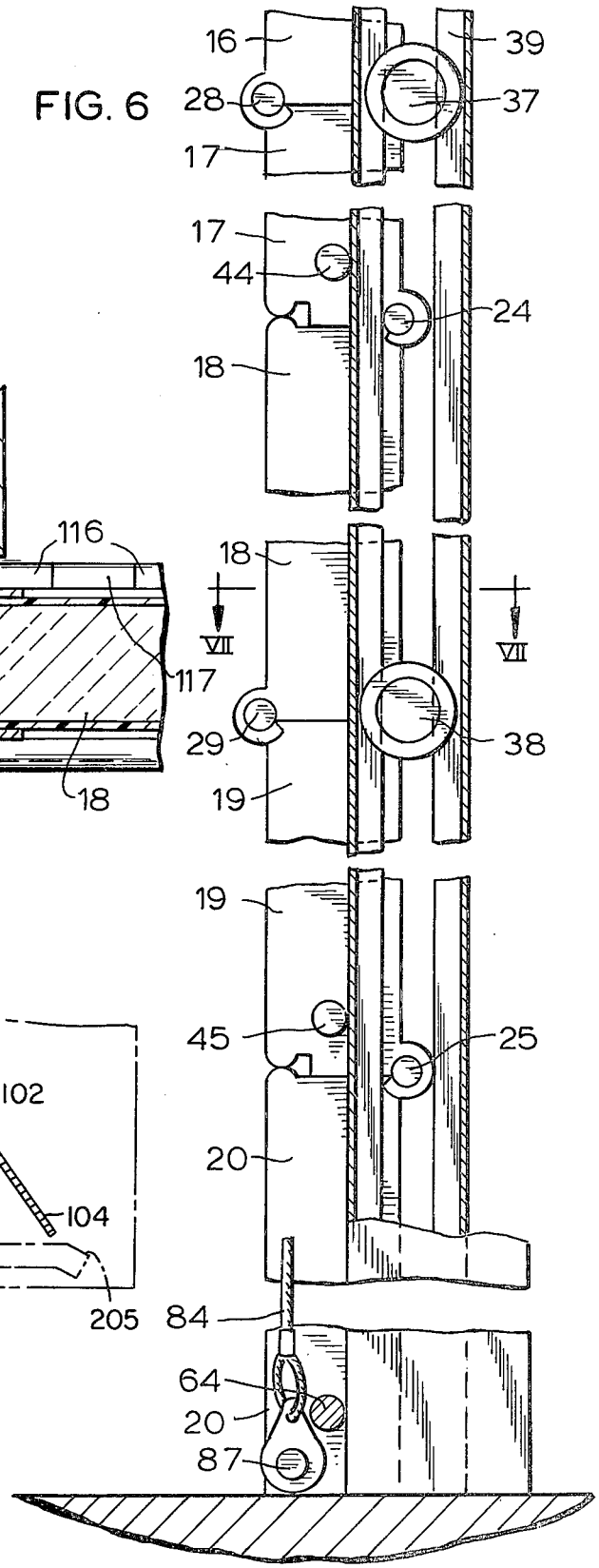
FIG. 6 is a side view of the door.
Figure 7:
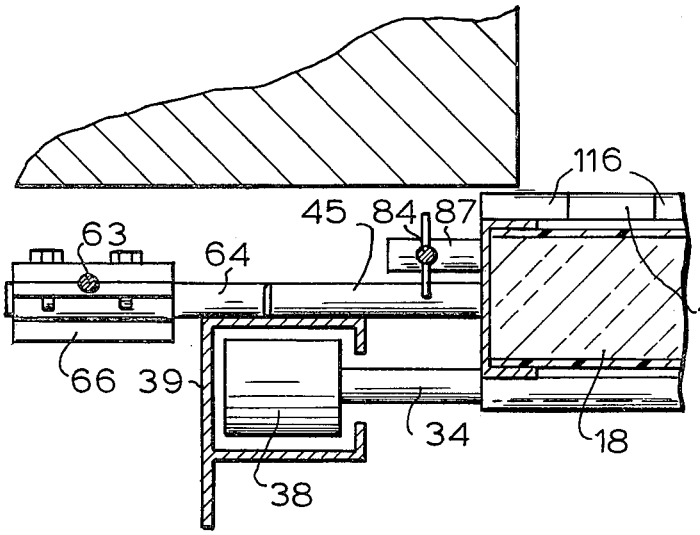
FIG. 7 is a detailed view of the hinge and roller structure.

FIG. 5 illustrates the details of the rollers and pins of the door panels. FIG. 6 illustrates the relationship of the rollers and the hinges to the door. FIG. 2 is a detailed sectional view illustrating the construction of the panels with each having side members 110 and 111 which are received in extrusions 112 and 113 that might be made of aluminum, for example. Foam such as styrofoam 114 is inserted into the panels and the hinges are formed of sections 116 and 117 that are receivable in adjacent panels and the panels are pinned together by hinge pins as illustrated. The rollers such as roller shaft 31 and roller 35 is also supported from the structures illustrated in FIG. 2. FIG. 7 comprises a detailed view of panel 18, hinges 116 and 117, roller 38 and roller shaft 34, guide pin 45 and pull rod 64.

It is to be realized that the rails 39 are formed as channels and thus the rollers are restrained therein. However, the pins 41–45 are not restrained.

Although the invention has been described with respect to preferred embodiments, it is not to be so limited as changes and modifications can be made which are within the full intended scope of the invention as defined by the appended claims.

We claim as our invention:

1. A collapsible door comprising, a frame, a plurality of horizontal extending panels joined edge-wise by hinges which are mounted alternately on the front and back of the door so that it can fold similar to an accordian, a pair of channel-shaped rails mounted on opposite edges of the door and having vertical portions and smaller horizontal portions joined by curved portions, rollers mounted on the ends of certain of said panels and received in said rails, and guide pins mounted on the ends of certain of said panels and adapted to slide on said pair of rails outside of the channels, including a first curved rail mounted on said frame above said door and adapted to engage the guide pins on said panels to deflect them so that they fold as an accordian when the door is opened, including a second curved rail mounted on said frame above said door and adapted to engage the guide pins on the upper one of said panels to invert it 180 degress from its position when the door is closed, wherein said second curved rail has an end closely adjacent said channel-shaped rail, and wherein said rollers are mounted on the second and fourth panels from the top of the door when it is closed.

2. A collapsible door according to claim 1, wherein said guide pins are mounted on the first, third and fifth panels from the top of the door when it is closed.

3. A collapsible door according to claim 2, including a horizontal drive shaft rotatably mounted above said door, a driving means connected to said horizontal drive shaft, first and second reels mounted on said drive shaft, a first cable attached to said first reel and to the lower panel of said door to open the door, a second cable attached to said second reel and attached to the lower panel of said door, and an idler pulley mounted adjacent the lower panel and said second cable passing over said idler pulley.

4. A collapsible door according to claim 3 including a counter balance spring connected to said door to counter balance its weight.

5. A collapsible door according to claim 4, wherein said counter balance spring comprises a coil spring with one end attached to a panel of said door, a second pulley rotatably attached to the other end of said spring, a third cable with one end attached to said frame and passing over said second pulley, a third pulley mounted to said frame and said third cable passing over said third pulley and attached to said door.

6. A collapsible door according to claim 1, wherein said panels are formed as flat planar members spaced apart and with the space therebetween filled with reinforcing foam.

* * * * *